United States Patent [19]

Underwood et al.

[11] 4,275,442

[45] Jun. 23, 1981

[54] ELECTRONIC TIC-TAC-TOE GAME

[76] Inventors: Johnny P. Underwood, 102 Sandy La.; Carl G. Bowden, P.O. Box 294, both of Waxahachie, Tex. 75165

[21] Appl. No.: 53,905

[22] Filed: Jul. 2, 1979

[51] Int. Cl.[3] ..... G06F 15/44

[52] U.S. Cl. ..... 364/410; 273/271; 364/411

[58] Field of Search ..... 364/410, 411; 273/1 R, 273/1 E, 237, 271; 340/384 E

[56] References Cited

U.S. PATENT DOCUMENTS

| | | | |
|---|---|---|---|
| 2,811,359 | 10/1957 | Haufe | 273/237 |
| 2,877,019 | 3/1959 | Keister | 364/410 |
| 3,145,993 | 8/1964 | Archer | 273/271 |
| 3,563,552 | 2/1971 | Korff et al. | 273/237 |
| 3,778,063 | 12/1973 | Strand | 273/237 |
| 3,878,675 | 4/1975 | Prociuk | 273/237 |
| 3,889,953 | 6/1975 | Grasham | 273/271 |
| 3,894,183 | 7/1975 | Barish | 178/18 |
| 3,914,548 | 10/1975 | Barish | 178/18 |
| 4,006,903 | 2/1977 | Barish | 273/271 |
| 4,149,727 | 4/1979 | Penney | 273/271 |

OTHER PUBLICATIONS

Lockhart, D. D.; "Tic-Tac-Toe Mate-A Computer that Plays Tic-Tac-Toe can be a Touch Opponent"; Popular Electronics; Nov. 1958; pp. 47-49.

Berkeley, E. C.; "Relay Moe Plays Tick Tack Toe"; Radio Electronics; Dec. 1956; pp. 50-52.

McCormick, E. M.; "Tick-Tack-Toe Computer", Electronics; vol. 25, No. 8; pp. 154-162; Aug. 1952.

Haufe, R.; "Design of a Tic-Tac-Toe Machine"; Pacific General Meeting Conference Paper Digests; *Electrical Engineer,* vol. 68; Oct. 1949; p. 885.

*Primary Examiner*—Errol A. Krass

*Attorney, Agent, or Firm*—Richards, Harris & Medlock

[57] ABSTRACT

Electronic tic-tac-toe game (10) includes a display board (12) having a tic-tac-toe array (14) printed on the display. The tic-tac-toe game (10) controls the electronic display of the selected "X's" (16) and "O's" (18) on display board (12). A game mode select switch (30) enables the game (10) to be played in the solitary mode of operation against a microprocessor (130) programmed to play tic-tac-toe or in a dual mode of operation between two players. In the dual mode of operation, players may electronically select their game symbols which then appear in player displays (20) and (22). A switch (28) enables the microprocessor (130) to control the time allotted for the microprocessor (130) to select a move in the solitary mode of operation or to limit the time the opposing player has to move in the dual mode of operation. Microprocessor (130) accumulates the wins for each player and displays these wins in total wins displays (24) and (26).

16 Claims, 6 Drawing Figures

ELECTRONIC TIC-TAC-TOE GAME

TECHNICAL FIELD

This invention relates to electronic games, and more particularly to an electronic tic-tac-toe game selectable for play by a solitary player against a programmable computer or for competitive play between two players, wherein the degree of difficulty may be set by an adjustable timer. The invention further relates to the means to electronically select a symbol and display that selection on a display board as the game progresses.

BACKGROUND ART

The game of tic-tac-toe has been played as an enjoyable pastime for many years. The rules of the game are easily understood and the game may be enjoyed by people of all ages.

The game may be played between two players who alternately select "X's" or "O's" to be placed in one of the nine boxes formed by two parallel lines intersecting at right angles with two other parallel lines. The first player begins play by placing an "X" in one of the nine boxes, and the second player places an "O" in another one of the nine boxes. The players continue to alternately place "X's" or "O's" in the array of nine boxes, and one of the players may win by placing three of his symbols in one of the three vertical columns, one of the three horizontal rows, or along one of the two diagonals. The game may also end in a draw if neither one of the two players is able to win in the manner described above.

There have been a number of electrical and mechanical versions of the game of tic-tac-toe designed for either solitary play or play between two players. In addition, electronic tic-tac-toe games are also known which allow a player to compete against a computer programmed to play tic-tac-toe. Such electronic tic-tac-toe games are also available in hand-held units utilizing an integrated circuit device known as a microprocessor as the computer. However, none of these devices are known to include the features disclosed in the electronic tic-tac-toe game of the present invention.

DISCLOSURE OF INVENTION

The electronic tic-tac-toe game of the present invention may utilize a microprocessor as the programmable computer, enabling the game to be housed within a compact hand-held unit. A game mode select switch is provided to determine the dual mode of play as well as which one of the two players will use the "X" symbol to commence play. It also enables one player to play against the programmed microprocessor for a game of tic-tac-toe in the solitary mode. An adjustable timer is provided to select a response time for both modes of operation. When the game is selected to operate in the solitary game mode for play against the computer, the timer may be adjusted to set the period of time the computer has to select its move, determining the degree of difficulty of the game. When the game is selected for play between two players, the adjustable timer also determines the degree of difficulty in the time a player is allowed to make a move before an audible tone is sounded.

At the opposite ends of a display board for the electronic tic-tac-toe game, a symbol display is provided to indicate the symbol to be used by that player. The computer is programmed to accumulate the total wins for each player, and the accumulation of these total wins is also displayed next to the player's symbol display. The selection of "X's" and "O's" on the display board is made by means of an electrical switch located over each of the nine boxes, so that the electrical switch is closed when the player places his finger on the site chosen for placement of his symbol.

In the preferred embodiment, the display means for the players' symbols and the total wins accumulated is a microprocessor controlled multiplexed liquid crystal display. The microprocessor stores the location of the selected symbols on the nine boxes of the display board and continues to multiplex the display to appear as a continuous display. An audible tone is also sounded each time the switch closes to indicate the selection of a player's move. The display remains until the game ends either in a draw or in a win for one of the players. The electronic tic-tac-toe game of the present invention may be energized by batteries and housed in a case to form a hand-held unit.

DETAIL DESCRIPTION

Figure 1:
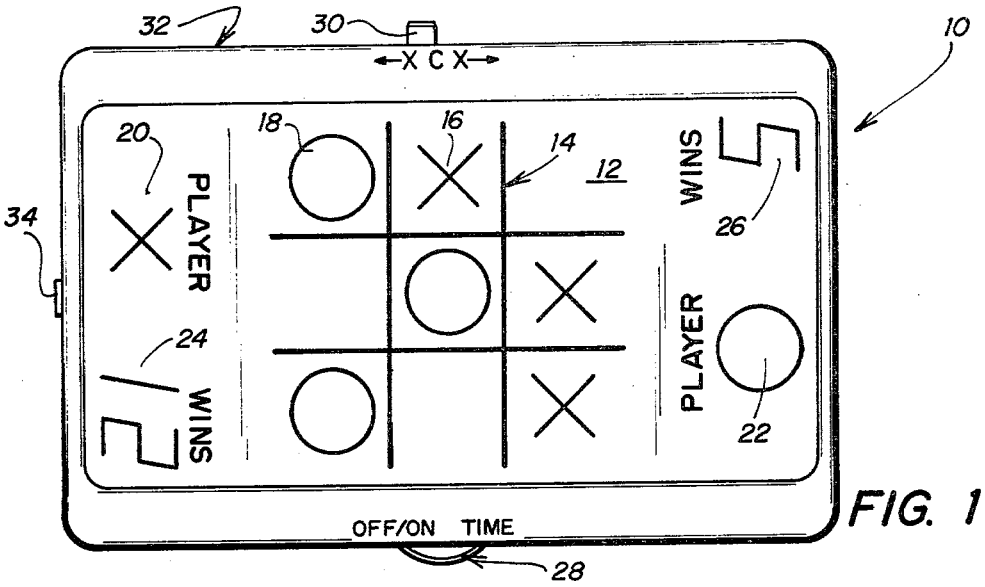
FIG. 1 is a top view of the present invention.

FIG. 1 is a plan view of the electronic tic-tac-toe game of the present invention, generally identified by the reference numeral 10. A display panel 12 has printed on its face the traditional tic-tac-toe array 14 of nine boxes as placement sites for the players' symbols. The "X's" 16 and "O's" 18 are the displayed game symbols selected by the two contestants. In the preferred embodiment, a liquid crystal display is utilized to implement the displayed game symbols 16 and 18. Of course, it is to be understood that other display means, such as light emitting diodes, may be utilized in the present invention.

The word "player" is printed on the panel 12 on opposite sides of the tic-tac-toe array 14 to designate the side of the array 12 facing each player. A player symbol display 20 and 22 appears below this heading for electronically displaying the symbol to be used by that player during the game. The word "wins" is also printed on the display panel on opposite sides of the array 14 for identifying the wins accumulators 24 and 26 for each of the players. In the preferred embodiment, the player symbol displays 20 and 22 as well as the wins accumulator displays 24 and 26 are implemented by a liquid crystal display. As mentioned above, other display means may be utilized without departing from the spirit of the invention.

An off/on switch 28 is provided for energizing the circuits of the electronic game 10, as well as providing means for adjusting the allotted time for placing game symbols on the display panel 12. The switch 28 is a thumb wheel switch which may be rotated past the "on" position to set the allotted period of time for selection of a site within the array 14 for one of the "X's" 16 or "O's" 18.

A game mode selector switch 30 is also provided to select whether the electronic tic-tac-toe game 10 is to be operated in the dual mode between two contestants or in the solitary mode for play by one contestant against the game's computer. The game mode selector switch 30 illustrated in FIG. 1 is in the dual mode of play position and it also determines that the "X" is to appear in player symbol display 20 for use throughout the game by that player. If the switch 30 is placed in the middle position, designated by the letter "C", the game 10 enables a single player to play against the game's computer. In the third position, the switch 30 would again be in the dual mode of play, but it would place the "x" symbol in player display 22 for use by that player throughout the game. The "O" symbol would then appear in player display 20.

The electronic tic-tac-toe game 10 is contained within a case 32, which may be constructed from injection molded plastic. The electronic components of the game 10 enable the case 32 to be dimensioned to fit within a player's hand. A battery charger 34 provides a means for charging the batteries energizing the game 10.

Figure 2:
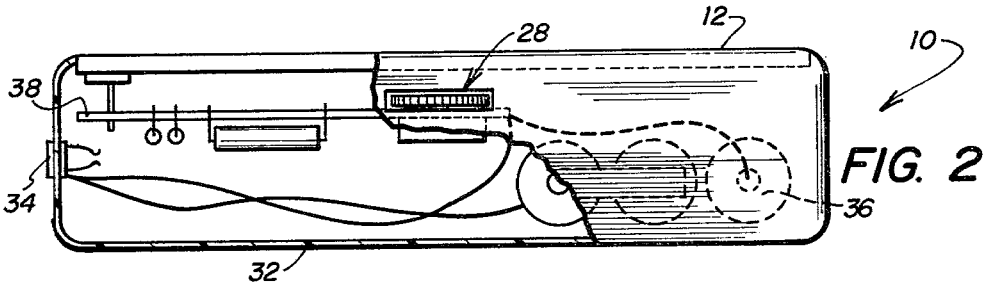
FIG. 2 is a side view of the interior of the present invention.

Referring to FIG. 2, a side view of the interior of the electronic tic-tac-toe game 10 illustrates the arrangement of the display panel 12, off/on switch 28, a battery charger 34, a battery pack 36, and a printed circuit board 38.

Figure 3:
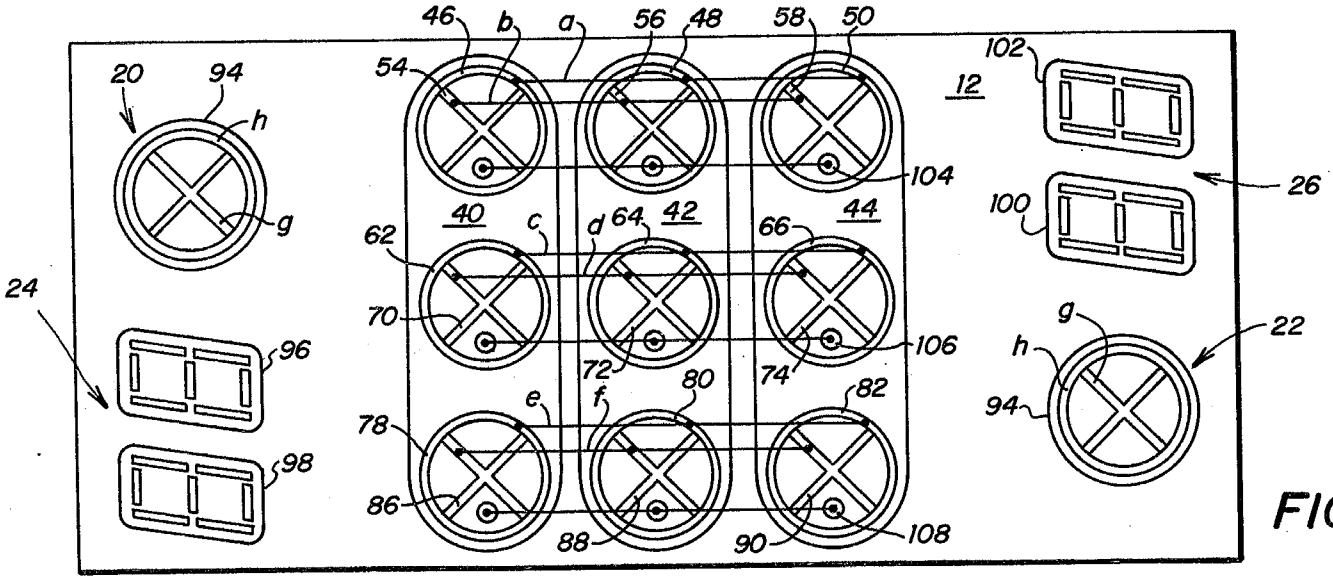
FIG. 3 is the layout of the display panel of the present invention.
Figure 4:
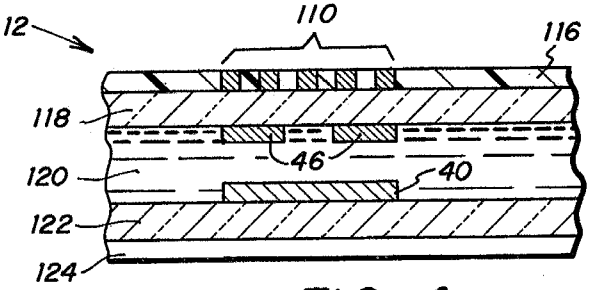
FIG. 4 is a cut away partial side view of the display panel of FIG. 3.

Referring to FIGS. 3 and 4, the display panel 12 is illustrated with the conductive paths to be applied for displaying the game symbols, the "X's" 16 and "O's" 18, as well as the total wins accumulator displays 24 and 26. The sites for the display of the game symbols, the "X's" 16 and "O's" 18, include three back pane display elements 40, 42, and 44. The upper display elements, a–g, in the sandwich construction illustrated in the cross section of FIG. 4 include a first horizontal row of "O's" 46, 48 and 50 interconnected by a conductive path "a." Similarly, the first horizontal row of "X" display elements 54, 56 and 58 are interconnected by a conductive path "b."

In the second horizontal row of display elements, the "O's" 62, 64 and 66 are interconnected by a conductive path "c" and the "X" display elements 70, 72 and 74 are interconnected by a conductive path "d." The third horizontal row includes upper "O" display elements 78, 80 and 82 interconnected by a conductive path "e," and the "x" display elements 86, 88 and 90 interconnected by a conductive path "f."

The player symbol displays 20 and 22 are formed by a back pane element 94 and an "X" upper display element "g" and "O" upper display element "h." The total wins accumulator display 24 includes back pane elements 96 and 98 with a seven segment upper display. Similarly, the total wins accumulator display 26 includes back pane display elements 100 and 102, each having a seven segment upper display.

Figure 5:
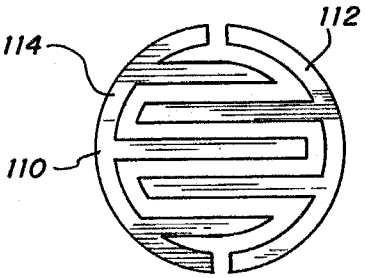
FIG. 5 is a top view of the symbol selector switch.

Finally, conductive paths 104, 106 and 108 are provided to interconnect the touch selector switches 110 (FIG. 5) in each of the three horizontal rows. A touch selector switch 110 is located over each of the nine boxes of the array 14 on the player's side of the display panel 12. The conductive paths of switch 110 would normally be transparent. One terminal 112 of the touch switch 110 is connected to one of the back pane display elements 40, 42 or 44 while the other terminal 114 is connected to one of the conductive paths 104, 106 or 108. The player closes the switch 110 by placing his finger on the site he chooses for his move and thereby completes the path between terminals 112 and 114.

FIG. 4 illustrates the sandwich construction of the liquid crystal display elements of the display panel 12. The conductive terminals 112 and 114 of the switch 110 are positioned in a first layer of insulating material 116 on the side of the display panel 12 facing the players. The switches 110 are separated by a layer of glass 118 from the upper "O" display element 46. In order to simplify the illustration, the "X" upper display element 54 is not illustrated in FIG. 4. A liquid crystal material fills the space 120 between the upper display element 46 and the back display element 40 which is supported by a layer of glass 122. A reflective tape 124 is placed on the bottom of the glass 122 to complete the sandwich construction of the liquid crystal display.

In normal operation, light from the room will pass through this sandwich construction, and it will be reflected out by the reflective tape 124 placed on the back of the glass sheet 122. When a player places his finger on the site selected for his symbol, he touches the selector switch 110 and completes the circuit between terminals 112 and 114. As described more fully below, a small voltage is caused to be applied between the upper display element 46 and the back display 40 causing crystals to block light from being reflected back out of the display. Thus, if the "O" player has touched the switch 110 over the upper display elements 46 and 54 in FIG. 3, the "O" symbol will appear to become black and visible.

Figure 6:
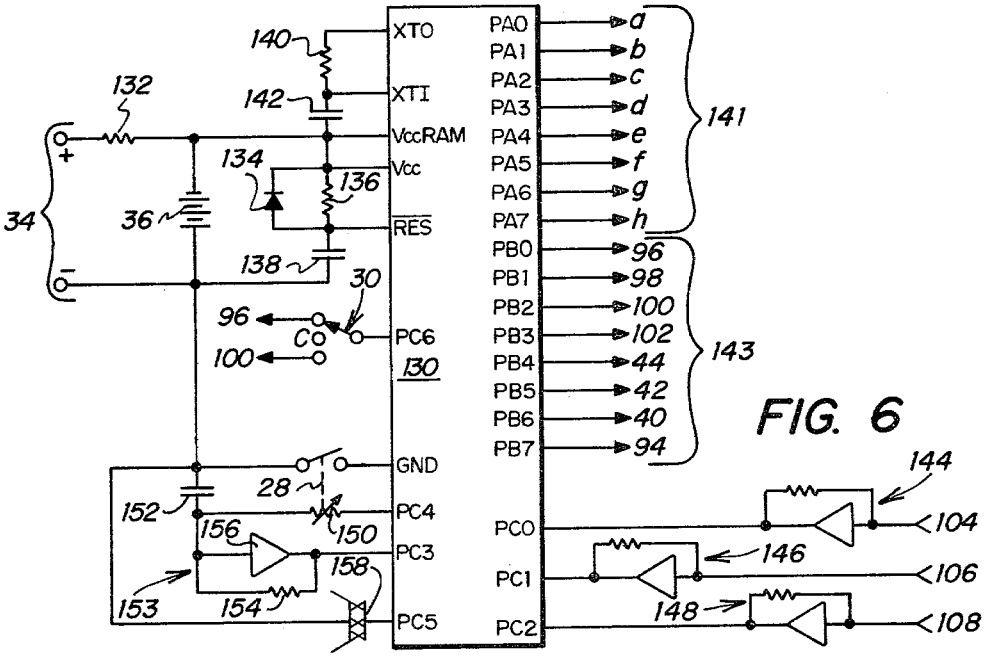
FIG. 6 is an electrical schematic diagram of the present invention.

Referring to FIG. 6, the microprocessor 130 is the computer that is programmable to control the operation of the electronic tic-tac-toe game 10. Microprocessor 130 is an integrated circuit device and a microprocessor commercially available from Symertek, as Model No. Sy6500/1 could be utilized in this invention.

The power to operate the circuitry of the game 10 is provided by rechargeable battery pack 36, connected to a resistor 132 to prevent the overcharging of the battery pack 36. A diode 134, a resistor 136 and a capacitor 138 comprise reset circuitry for resetting and initializing the microprocessor 130 when power is applied. Resistor 140 and capacitor 142 are provided to provide a feedback circuit for the central timing pulses for the microprocessor 130. The first output port (PA0–PA7) 141 provides the voltage to the upper display elements "a–h," while the second output port (PB0–PB7) 143 provides the ground paths for the back pane elements 40, 42, 44, 94, 96, 98, 100, 102, as well as the signals for each of the nine touch switches 110. The touch switch input signals from conductive paths 104, 106 and 108 are amplified and conditioned by buffers 144, 146, and 148. The buffers 144, 146 and 148 are implemented by an integrated circuit device including a resistor causing these buffers to function as Schmidt triggers to reduce the outside noise the touch switches 110 may pick up from the player. The conditioned signals from the touch switches 110 are sent to the ports PC0–PC2 of the microprocessor 130.

The off/on switch 28 includes an adjustable resistor 150 for charging a capacitor 152 under the control of the microprocessor 130 to set up the allowed time for player moves. The timer is started by the microprocessor 130 applying a voltage through the variable resistor 150 to the capacitor 152 and the amplifier 153 formed by the resistor 154 and buffer of integrated circuit device 156. Through a period of time determined by the setting of the variable resistor 150, the capacitor 152 will charge, allowing the amplifier 153 to signal the microprocessor 130.

A piezoelectric speaker 158 is connected to one output port of the microprocessor 130 to form the audible tone generator of the electronic game 10.

Selector switch 30 is a three position switch from port PC6 of microprocessor 130. It is shown connected to back pane 96 for displaying an "X" in the player symbol display 20 which will also cause the microprocessor to display an "O" in the display 22. In the center position "C," the game 10 is in the solitary mode of operation. In the third position, the port PC6 of the microprocessor 130 is connected to back pane element 100 to enable an "X" to appear in display 22 and an "O" to appear in display 20. In operation, the game mode selector switch 30 is set to determine whether the game 10 is to operate as a solitary tic-tac-toe game or a tic-tac-toe game between two opposing contestants. The selector switch 30 as illustrated in FIG. 1 is positioned for play between two opposing contestants.

The off/on switch 28 is turned to the "on" position to energize the microprocessor 130 and its associated circuitry. The rotary thumb wheel switch 28 may be further rotated to set the variable resistor 150 to determine the allowed time for a player to select his move. Upon initially energizing the game 10, the display panel 12 will be completely blank, an "X" will appear at player symbol position 20 and an 'O" will appear on play symbol position 22. Accumulated wins displays 24 and 26 will be cleared to show zeros.

The "X" player makes the first move by placing his finger on the display panel 12 on top of one of the nine boxes formed by the array 14, closing a touch switch 110. The piezoelectric speaker 158 will provide a "beep" and an "X" will be displayed in that box. The "O" player has the next move, and must make that move in the time allotted by the switch 28. The players continue to alternate moves until a winner is determined. The player winning the game has one count added to the wins accumulators 24 or 26, and the display panel 12 displays the selected "X's" 16 and "O's" 18 for a short predetermined period of time, e.g., ten seconds, and the piezoelectric speaker 158 beeps continuously. The display panel 14 is automatically cleared after this predetermined period of time by the microprocessor 130 and play may resume upon a second game. In the next game, the winning player is normally given the "X" to begin first, which may be set up by the game mode selector switch 30. The "X" player may be changed without destroying the total in the wins accumulators 24 or 26. In the event the game ends in a draw, the display panel 12 is cleared and no count is added to either of the total wins accumulators.

If the selector switch 30 is moved to position "C" in FIG. 1, the game 10 is in the solitary mode for play by a single player against the preprogrammed microprocessor 130. The off/on switch 28 may be set to control the period of time the microprocessor 130 has to perform its program routine to select the optimum move according to its program. In the solitary mode, the first move is always taken by the microprocessor 130. However, the first move is determined at random, so the player is given a fair opportunity to compete against the microprocessor 130. The time control may be set by the switch 28. In the shortest time mode, the microprocessor 130's moves are determined at random, which would enable the player to win easily. The longer period of time that is provided to the microprocessor 130 by the timer switch 28, the longer the microprocessor 130 has to run through its program routine to determine its best move. In this way, the player may control the degree of difficulty in playing in the solitary mode against the computer.

All the preferred embodiments of the invention have been illustrated in the accompanying drawings and described in the foregoing detailed description. It will be understood that the invention is not limited to the embodiments disclosed, but is capable of numerous rearrangements, modifications and substitution of parts and elements without departing from the spirit of the invention.

We claim:

1. An electronic tic-tac-toe game, comprising:

a display board having an array of nine boxes formed by two parallel lines intersecting at right angles with two other parallel lines;

switching means for selecting a circle or cross for one of the nine boxes of the tic-tac-toe array;

display means responsive to said switching means for displaying the selected tic-tac-toe symbol in one of the boxes of said array;

an electronic digital signal processor for controlling said dislay means and for determining the end of game condition;

means for automatically clearing said display means after said electronic digital signal processor has determined the end of game condition;

means on said display board for indicating the game symbol to be used by each player; and means for preselecting at the start of the game the game symbol to be used by each player.

2. The electronic tic-tac-toe game of claim 1 and further comprising:

means for said electronic digital signal processor to count the total number of wins for each of the players; and means for displaying the total accumulated wins for each player on said display board.

3. The electronic tic-tac-toe game of claim 2 and further comprising:

means for predetermining the response time for a player to activate said switching means for selecting the location of a game symbol in one of said boxes on said tic-tac-toe array, wherein said means for predetermining the response time is adjustable to vary the length of time allotted each player for selecting the location of a game symbol; and alarm means for indicating the location of a game symbol has not been elected in the time allowed by said predetermined response time means.

4. The electronic tic-tac-toe game of claim 1, wherein said electronic digital signal processing means is preprogrammed to play tic-tac-toe and further comprising a game mode selector switch for placing said electronic digital signal processor in a solitary game mode for one player to play against the electronic digital signal processor or in a dual mode of play between two players.

5. The electronic tic-tac-toe game of claim 1, wherein said electronic digital signal processor is a microprocessor integrated circuit device.

6. The electronic tic-tac-toe game of claim 1, wherein said switching means is an open circuited switch positioned over the display means of each of the nine boxes of the tic-tac-toe array, said switch means being activated to select a symbol by a player touching the switch to close the circuit.

7. An electronic tic-tac-toe game, comprising:

a display board including an array of nine areas formed by two parallel lines intersecting at right angles with two other parallel lines;

a means for selecting a circle or a cross as the tic-tac-toe game symbols to be placed in one of the nine areas of the array;

means for displaying selected tic-tac-toe game symbols in the boxes of the tic-tac-toe array in response to said selecting means;

a microprocessor for controlling said display means in response to said selecting means;

indicating means responsive to said selecting means for audibly indicating the selection of a game symbol;

a game mode selector switch for determining that the tic-tac-toe game operates in a dual player mode for play between two contestants or in a solitary mode for one player competing against selections made by said microprocessor;

said microprocessor including means for determining an end of game condition; and means for automatically clearing said display means in response to an end of game signal from said microprocessor.

8. The electronic tic-tac-toe game of claim 7, and further comprising:

an adjustable timer for determining the period of time allowed for the selection of a game symbol by an opposing player in said dual mode of operation or by the tic-tac-toe program of said microprocessor in said solitary mode of operation, wherein said adjustable timer provides a means to vary the degree of difficulty of play in said solitary or dual modes of operation.

9. The electronic tic-tac-toe game of claim 8 and further comprising an audible tone generator controlled by said microprocessor to generate an audible tone upon the expiration of the time selected for a player to select a game symbol in said dual mode of operation.

10. The electronic tic-tac-toe game of claim 7, wherein said display means is a liquid crystal display.

11. The electronic tic-tac-toe game of claim 7, wherein said microprocessor is programmed to accumulate the total number of wins for a player in either the dual or solitary mode of operation further comprising:

display means for displaying said accumulated total of games won.

12. The electronic tic-tac-toe game of claim 7, further comprising a selector switch for determining in the dual mode of operation which of the two contestants uses the cross as the first symbol to open play of the tic-tac-toe game.

13. The electronic tic-tac-toe game of claim 7, wherein said display means is a multiplexed display under the control of said microprocessor, such that the frequency of displaying said game symbols occurs at such a sufficiently high rate of speed to appear as a continuous display.

14. The electronic tic-tac-toe game of claim 7, wherein said means for selecting said game symbol is positioned above each of the nine game symbol display means, said selecting means being activated by the contact of a player's finger with the area of the array selected for displaying his game symbol.

15. The electronic tic-tac-toe game of claim 7, wherein said microprocessor is programmed to randomly select a cross for display on said display board as the first game symbol, whereby an element of chance is introduced into the game to improve the player's chances of winning against the microprocessor in the solitary game mode of operation.

16. The electronic tic-tac-toe game of claim 7, wherein said adjustable timer controlling the response time allotted said microprocessor in said solitary game mode of operation is adjustable to a minimum time to cause said microprocessor to randomly select the placement of its symbols on said display board.

* * * * *

UNITED STATES PATENT AND TRADEMARK OFFICE

CERTIFICATE OF CORRECTION

PATENT NO. : 4,275,442

DATED : June 23, 1981

INVENTOR(S) : Johnny P. Underwood et al.

It is certified that error appears in the above—identified patent and that said Letters Patent is hereby corrected as shown below:

Column 2, line 51, change "12" to --14--.

Column 5, line 28, change "'0"" to --"0"--.

Signed and Sealed this

*Eighth* Day of *September 1981*

[SEAL]

*Attest:*

GERALD J. MOSSINGHOFF

*Attesting Officer*

*Commissioner of Patents and Trademarks*